US008186666B2

(12) United States Patent
Asaoka et al.

(10) Patent No.: US 8,186,666 B2
(45) Date of Patent: May 29, 2012

(54) CONVEYING DEVICE AND IMAGE FORMING DEVICE

(75) Inventors: Junichi Asaoka, Saitama (JP); Akira Sunazawa, Kanagawa (JP); Tomonari Sakurai, Saitama (JP); Katsunori Suzuki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/859,700

(22) Filed: Aug. 19, 2010

(65) Prior Publication Data

US 2011/0085837 A1 Apr. 14, 2011

(30) Foreign Application Priority Data

Oct. 9, 2009 (JP) ..... 2009-234875

(51) Int. Cl.
*B65H 5/00* (2006.01)
*B65H 1/00* (2006.01)

(52) U.S. Cl. ..... 271/10.01; 271/10.09; 271/162

(58) Field of Classification Search ..... 271/10.01, 271/10.09, 10.11, 162
See application file for complete search history.

(56) References Cited

U.S. PATENT DOCUMENTS

| | | | | |
|---|---|---|---|---|
| 5,395,102 | A * | 3/1995 | Eguchi | 271/10.04 |
| 2002/0163118 | A1* | 11/2002 | Inoue | 271/162 |
| 2003/0075857 | A1* | 4/2003 | Matsuki et al. | 271/162 |
| 2005/0067752 | A1* | 3/2005 | Inoue et al. | 271/10.01 |

FOREIGN PATENT DOCUMENTS

| | | | |
|---|---|---|---|
| JP | 10-147440 | A | 6/1998 |
| JP | 2000-016605 | A | 1/2000 |
| JP | 2002-154673 | A | 5/2002 |

* cited by examiner

*Primary Examiner* — David H Bollinger
(74) *Attorney, Agent, or Firm* — Sughrue Mion, PLLC

(57) ABSTRACT

A conveying device includes: a main body; a holding unit that holds media that is attached and detached to and from the main body; a third conveying member that conveys a single medium among the media held in the holding unit; a first conveying member that conveys the single media; a second conveying member that faces the first conveying member to pinch the media so as to conveys the single media with the first conveying member; a feed unit that feeds the single medium to the main body; an attaching part that is provided at the feed unit and enables the feed unit to attach to the holding unit; a positioning mechanism that positions the main body and the feed unit so that the second conveying member is located at a predetermined position relative to the first conveying member when the holding unit is loaded on the main body.

11 Claims, 7 Drawing Sheets

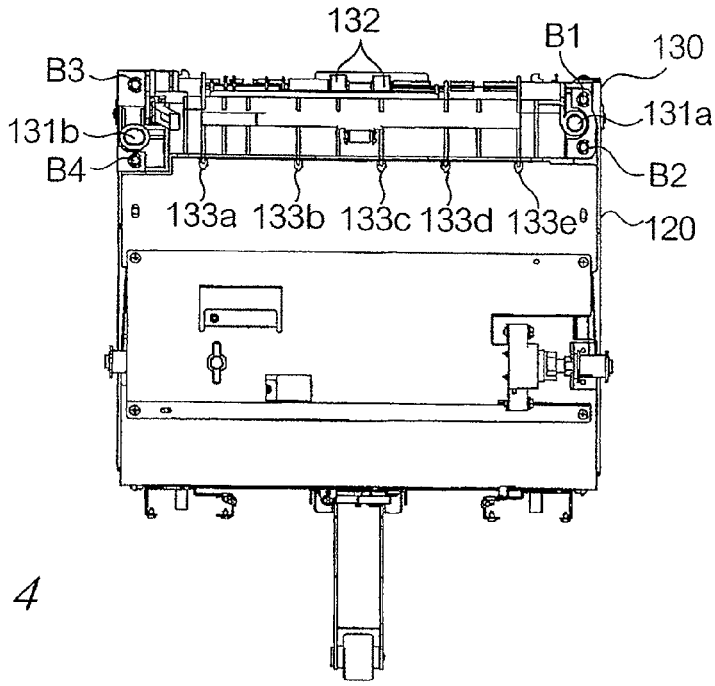
FIG. 4
FIG. 5
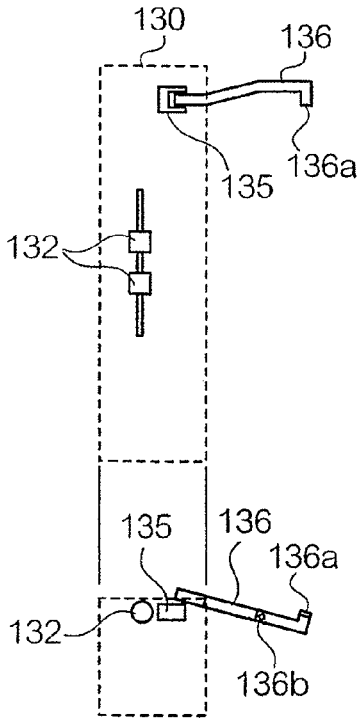
FIG. 11A
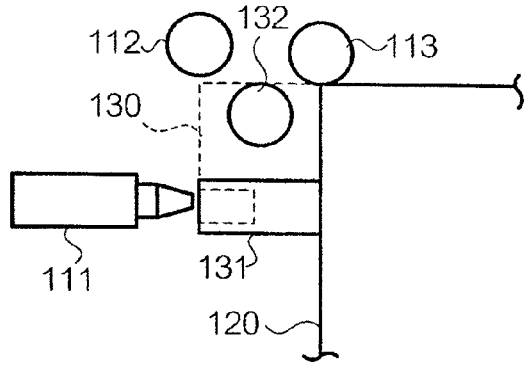
FIG. 11B
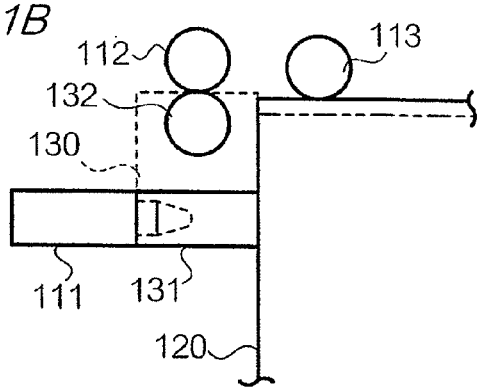

CONVEYING DEVICE AND IMAGE FORMING DEVICE

CROSS-REFERENCE TO RELATED APPLICATIONS

This application claims priorities under 35 USC 119 from two Japanese patent application No. 2009-234875 filed on Oct. 9, 2009.

BACKGROUND

1. Technical Field

The present invention relates to a conveying device and an image-forming device.

2. Related Art

Technologies for positioning paper-feeding units are known.

SUMMARY

The present invention enables a media feeding part of a holding unit to perform positioning regardless of whether a weight of a held media is heavy or light.

According to one aspect of the invention, there is provided a conveying device, including: a main body including a first conveying member that conveys a single media; a holding unit that holds a plurality of media accumulated in a vertical direction relative to an installation surface on which the conveying device is installed and is attached and detached to and from the main body through movement in a direction parallel to the installation surface; a feed unit that feeds the single medium to the main body, and includes an attaching part and a second conveying member and a second conveying member, the attaching part enabling the feed unit to attach to the holding unit, the second conveying member facing the first conveying member to pinch the media at a position facing the first conveying member so as to conveys the single media with the first conveying member; a third conveying member that conveys a single medium which is on the uppermost surface among the plurality of media held in the holding unit and is separated from the plurality of media; and a positioning mechanism that positions the main body and the feed unit so that the second conveying member is located at a predetermined position relative to the first conveying member when the holding unit is loaded on the main body, wherein the attaching part is configured to allow relative movement of the feed unit and the holding unit, and the feed unit is positioned relative to the main body.

BRIEF DESCRIPTION OF THE DRAWINGS

Exemplary embodiments of the present invention will be described in detail based on the following figures, wherein:

FIG. 4 shows a configuration of a feed unit;

FIG. 5 schematically shows the configuration of a sensor and a lever;

FIG. 11 schematically shows the positional relationships of a main body, a holding unit, and a feed unit when the holding unit is loaded;

DETAILED DESCRIPTION

1. Exemplary Embodiment

Figure 1:
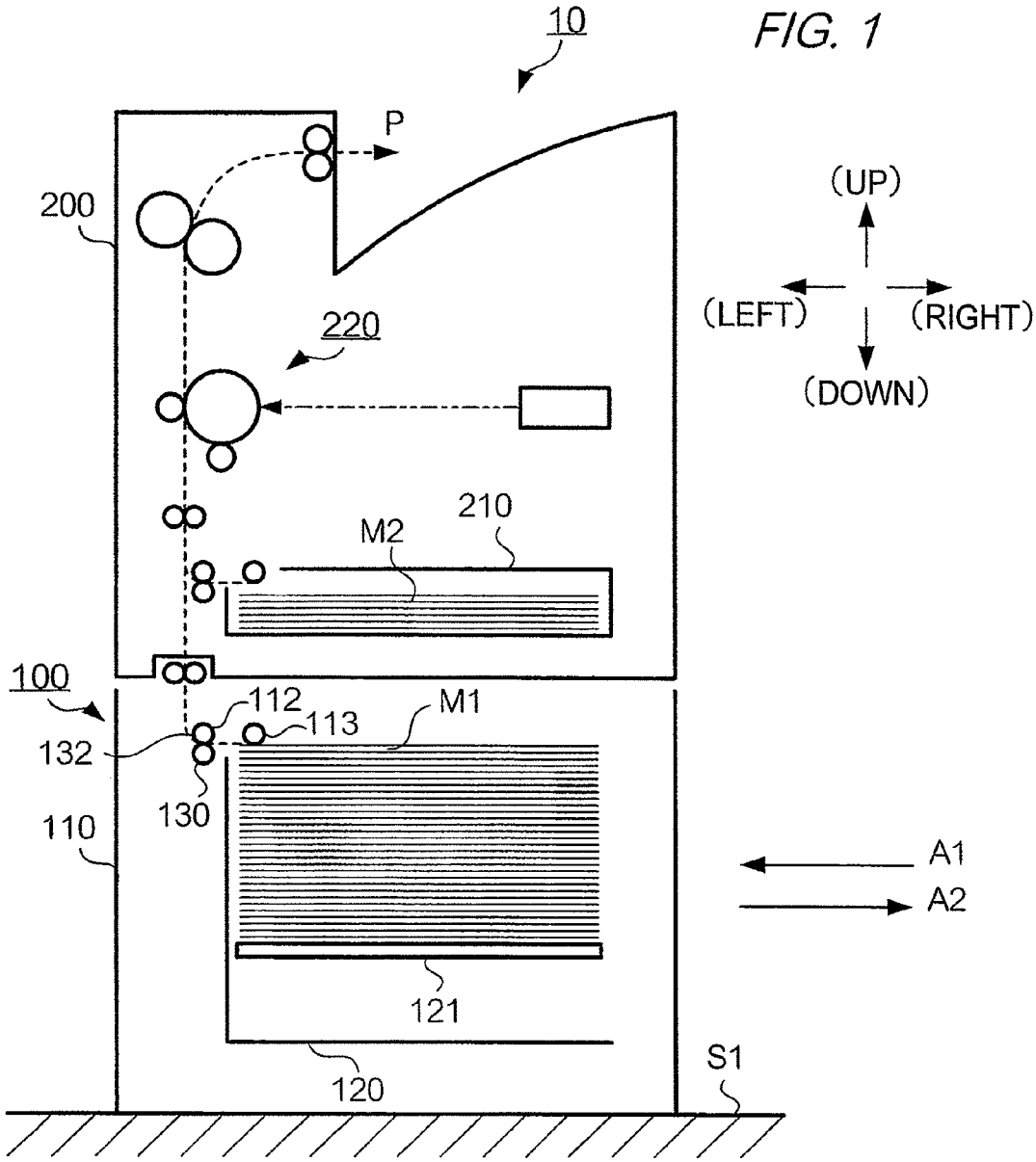
FIG. 1 schematically shows an outline of the configuration of an image forming system.

FIG. 1 schematically shows an outline of a configuration of an image forming system that is an exemplary embodiment of the present invention. Image forming system 10 of the present exemplary embodiment is configured by coupling conveying device 100 and image forming device 200 to function in concert, and forms images on held recording media M1. Conveying device 100 can be attached to and detached from image forming device 200, and image forming device 200 forms images using held recording media M2 when conveying device 100 is not loaded. These recording media are conveyed through the route indicated in the diagram by arrow P with a dotted line.

In the present exemplary embodiment, "recording media" refers to sheet-shaped media that are used for storing information, and on which images are formed by image forming device 200. These media are one example of recording media related to the present invention. The recording media are typically paper sheets, but are not limited to paper sheets, and may be, for example, plastic sheets. Moreover, in a case that the media is paper, among the paper media a variety of thicknesses and surface properties may be present. However, media relating to the present invention may be media for conveyance only, and may be media on which no information is stored.

Conveying device 100 includes main body 110 and holding unit 120. Main body 110 has a configuration that is attachable to and detachable from image forming device 200, and has a route for recording media M1 that connects to the route included in image forming device 200. Holding unit 120 holds recording media M1 and is configured to be attachable to and detachable from main body 110 through back-and-forth movements. Holding unit 120 includes lift 121 that bears recording media M1 and moves lift 121 according to the amount of recording media M1. Moreover, holding unit 120 is loaded by being moved in the direction of arrow A1 in the figure (hereinafter referred to as "loading direction"), and is disengaged (i.e., released from a loaded state) by being moved in the direction of arrow A2 (hereinafter referred to as "disengaging direction"). Attachment and detachment of holding unit 120 are performed by the user. The user attaches or detaches holding unit 120 in an operation, for example, of refilling recording media.

The state in which holding unit 120 is disengaged need only be a state in which refilling of recording media is possible, and it is not always necessary for holding unit 120 to be separated from main body 110. For example, holding unit 120 may be configured so as not to be separated by providing a stopper that limits movement in the disengaging direction up to a predetermined position. Moreover, attachment and detachment of holding unit 120 may involve not only force exerted by the user alone but also a supplementary mechanical force provided by conveying device 100.

Image forming system 10 is normally used in a state in which it is placed on installation surface S1. Installation surface S1 is a surface on which image forming system 10 is installed, and it is preferably horizontal. Holding unit 120 engages in back-and-forth movements in a direction parallel to installation surface S1 (preferably a horizontal direction). Moreover, recording media M1 is held so as to be accumulated in a vertical direction relative to installation surface S1. For ease of explanation, in the following description, the direction in which gravity acts when image forming system 10 is placed on a horizontal installation surface S1 is referred to as "downward," and the direction opposite to the direction in which gravity acts is referred to as "upward." Moreover, in this case, for ease of explanation, the loading direction is the leftward direction while the disengaging direction is the rightward direction.

Figure 2:
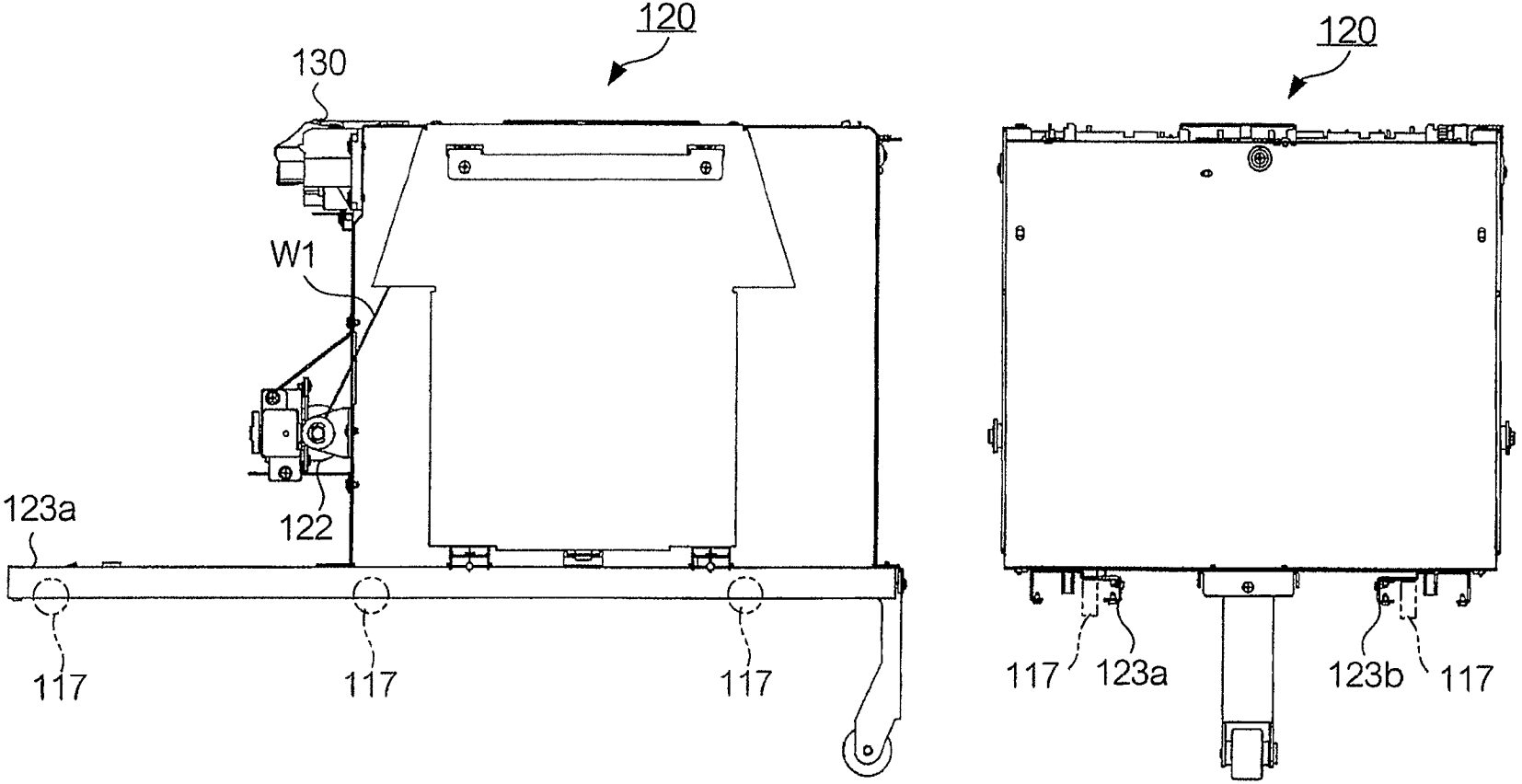
FIG. 2 shows a configuration of the lateral surface side of a holding unit.

FIG. 2 shows a configuration of holding unit 120. Holding unit 120 includes drive unit 122 and rail members 123*a* and 123*b*. Drive unit 122 receives driving force from a motor (not shown) provided on main body 110 and moves lift 121 via wire W1. Wire W1 has one end connected to drive unit 122 and, via a pulley or the like, the other end is connected to lift 121 (refer to FIG. 1) that is provided internally. Lift 121 moves upward when drive unit 122 winds up wire W1 and causes recording media M1 to move. In other words, lift 121, drive unit 122, and wire W1 work in concert to function as a transportation unit according to an aspect of the present invention. When holding unit 120 is moved in the disengaging direction and the driving force from the motor of main body 110 is not transmitted to drive unit 122, lift 121 moves downward. Rail members 123*a* and 123*b* are provided on the bottom surface of holding unit 120 along multiple wheels 117 provided on main body 110 and guide movement of holding unit 120 in the loading direction or the disengaging direction.

Figure 3A:
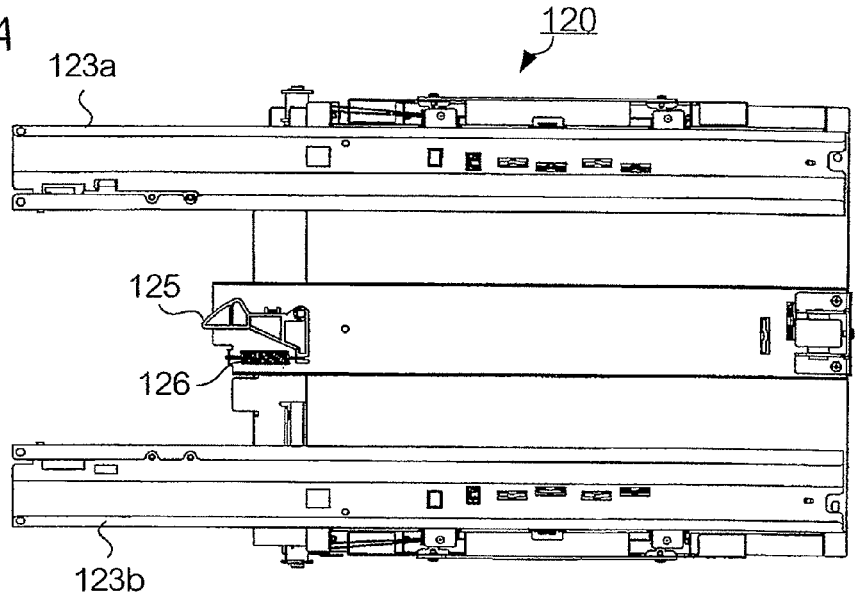
FIG. 3 shows a configuration of the bottom surface side of a holding unit.
Figure 3B:
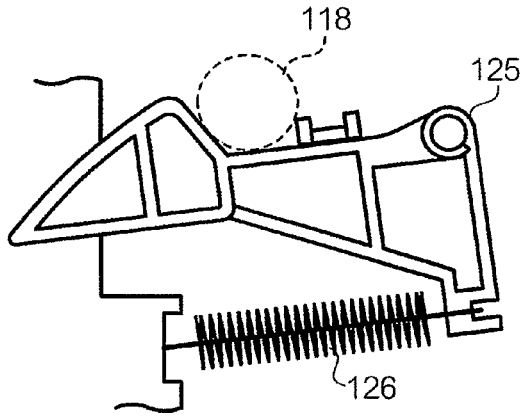

FIG. 3 shows a configuration of the bottom surface side of holding unit 120. In addition to rail members 123*a* and 123*b*, holding unit 120 includes latch 125 and elastic member 126 on the bottom surface thereof. As shown in FIG. 3B, when holding unit 120 is loaded, latch 125 is hooked to pin 118 provided on main body 110. At this time, latch 125 is provided with a force that presses pin 118 by elastic member 126 to prevent main body 110 from becoming disengaged. In the present exemplary embodiment, elastic member 126 is what is known as a tension spring. When the user pulls holding unit 120 in the disengaging direction with a force greater than the force of elastic member 126, latch 125 is released from the state of preventing main body 110 from becoming disengaged and holding unit 120 is disengaged. In other words, latch 125 and elastic member 126 function so that holding unit 120 remains at a fixed position relative to main body 110. Consequently, latch 125 and elastic member 126 may be included in the part of the positioning mechanism according to an aspect of the present invention.

Moreover, feed unit 130 is attached to holding unit 120. Feed unit 130 of the present exemplary embodiment is composed of different members to holding unit 120, and is attached by use of screws and bolts.

FIG. 4 shows feed unit 130 from the side of the left lateral surface of holding unit 120 (i.e., the side on which recording media M1 is discharged to main body 110). As shown in this figure, feed unit 130 includes concave parts 131*a*, 131*b*, conveying member 132, and comb parts 133*a*, 133*b*, 133*c*, 133*d*, and 133*e*, and is attached to holding unit 120 using bolts B1, B2, B3, and B4 (and corresponding nuts that are not illustrated). Concave parts 131*a* and 131*b* are provided at positions corresponding to convex parts 111*a* and 111*b* (described below) and have circular holes into which convex parts 111*a* and 111*b* are inserted. These holes may be depressions with a bottom or perforations that pass through the entirety of feed unit 130. Bolts B1, B2, B3, and B4 are respectively inserted into attaching parts 134*a*, 134*b*, 134*c*, and 134*d* (not shown in FIG. 4) and fixed in holding unit 120. Conveying member 132 is a roll-shaped member for conveying recording media M1 and is one example of a second conveying member according to an aspect of the present invention. Conveying members according to an aspect of the present invention are not limited to being roll-shaped and may have any shape that does not hinder the conveyance of recording media at a desired timing.

Moreover, feed unit 130 includes sensor 135 and lever 136, neither of which is shown in FIG. 4. Sensor 135 and lever 136 work in concert to configure a detection part according to an aspect of the present invention. Furthermore, sensor 135 may be provided at any position on main body 110 or may be provided on feed unit 130.

FIG. 5 schematically shows configurations of sensor 135 and lever 136. Here, for ease of explanation, only an overview is provided for parts of feed unit 130 other than conveying member 132, sensor 135, and lever 136. Lever 136 has contact part 136*a* that comes into contact with recording media M1 and rotates about rotational axis 136*b*. According to the configuration of lever 136, when lever 136 is at a predetermined position, conveying member 113 (described below) comes into contact with recording media M1 at an ideal pressure. When lift 121 ascends, the media at the uppermost surface of recording media M1 held by holding unit 120 comes into contact with contact part 136*a*. When lift 121 continues to ascend while contact part 136*a* is in contact with recording media M1, contact part 136*a* is moved upward. Sensor 135 is a sensor that optically detects the position of lever 136.

Figure 6:
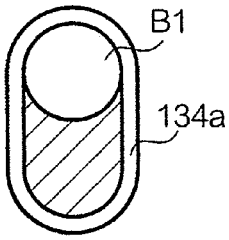
FIG. 6 shows a configuration of an attaching part.

FIG. 6 shows a configuration of attaching part 134*a*. Attaching part 134*a* is a perforation into which the shank of bolt B1 is inserted. In the present exemplary embodiment, attaching part 134*a* is in the form of an elongated hole, but the hole may also be formed to be circular. Attaching part 134*a* is configured to allow vertical motion relative to bolt B1. In other words, attaching part 134*a* is configured to allow relative vertical motion in relation to holding unit 120 to which bolt B1 is fixed.

Furthermore, attaching parts 134*b*, 134*c*, and 134*d* each have the same configurations as attaching part 134*a*, and they differ from attaching part 134*a* only in the positions at which they are provided. Therefore, descriptions regarding attaching parts 134*b*, 134*c*, and 134*d* are hereinafter omitted unless otherwise necessary.

Attaching part 134*a* is configured to allow movement of feed unit 130 in a predetermined direction. Here, the predetermined direction ideally matches the direction of gravitational force acting on recording media M1 held by holding unit 120 as well as the opposite direction (i.e., the vertical direction). When installation surface S1 is not horizontal and is tilted relative to the horizontal plane, the direction of movement does not match the vertical direction, but according to this configuration, elements of the vertical direction are at least included in the direction of movement. In other words, image-forming system 10 of the present exemplary embodiment is not designed for use with a tilt of 90° relative to the state shown in FIG. 1.

Furthermore, the number of attaching parts is not limited to 4. For example, the configuration described above performs the desired actions even when changed to a configuration in which attaching parts 134*a* and 134*b* are omitted, and the same applies in a case that more than 4 attaching parts are provided.

Moreover, an allowable range of movement of feed unit 130 is preferably determined according to the tolerance of components of each part and a weight of recording media M1 receivable in holding unit 120. Specifically, the allowable range of movement of feed unit 130 is designed so that feed unit 130 is positioned appropriately both when the maximum receivable amount of recording media M1 is held in holding unit 120 and when recording media M1 has not been held in holding unit 120. Furthermore, in consideration of cases in which installation surface S1 is not horizontal, this allowable range is preferably a range that provides for some leeway.

When no force other than gravitational force is acting on feed unit 130, bolt B1 comes in contact with the top part of attaching part 134*a*. At this time, feed unit 130 is supported by bolts B1, B2, B3, and B4 so as not to move further downward. In other words, at this time, feed unit 130 is supported by bolts B1, B2, B3, and B4 in a suspended state.

Comb parts 133*a*, 133*b*, 133*c*, 133*d*, and 133*e* are provided on the lower end (i.e., the end on the lower side) of feed unit 130. Concave parts 124*a*, 124*b*, 124*c*, 124*d*, and 124*e*, which are concavities that interlock with the convex parts formed by comb parts 133*a*, 133*b*, 133*c*, 133*d*, and 133*e*, are provided on the top end of holding unit 120 (i.e., the end facing the lower end of feed unit 130). In other words, comb parts 133*a*, 133*b*, 133*c*, 133*d*, and 133*e* and concave parts 124*a*, 124*b*, 124*c*, 124*d*, and 124*e* form one example of convex and concave shapes according to an aspect of the present invention.

These convex and concave shapes prevent recording media M1 from entering gaps generated at positions where holding unit 120 faces feed unit 130. In other words, compared to cases in which they are not provided, these convex and concave shapes render the shape of gaps nonlinear, thus making entry of recording media M1 accumulated in a planar state difficult.

These convex and concave shapes are preferably configured so that a height of the upper end of holding unit 120 extends in the vertical direction above the positions of the tips of comb parts 133*a*, 133*b*, 133*c*, 133*d*, and 133*e* when feed unit 130 is at either position within the allowable range of movement.

Figure 7:
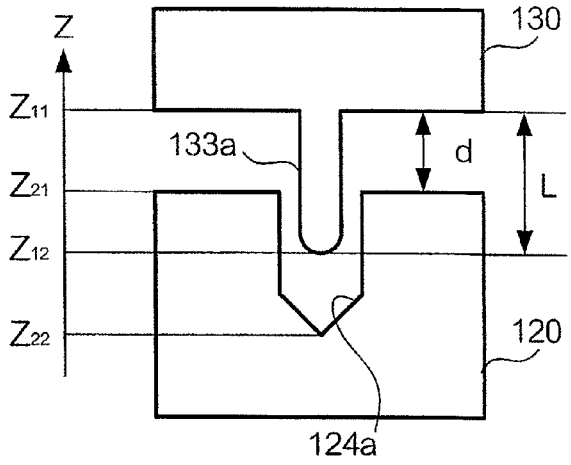
FIG. 7 shows the positional relationship between comb parts and concave parts.

FIG. 7 shows the positional relationship between comb part 133*a* and concave part 124*a*. Here, the vertical direction relative to installation surface S1 is the Z-axis, and the upward direction is defined as the positive direction. Moreover, the position of the lower end (excluding the comb part) of feed unit 130 in the Z-axis direction is defined as $Z_{11}$, the position of the tip of comb part 133*a* in the Z-axis direction is defined as $Z_{12}$, the position of the top end of holding unit 120 in the Z-axis direction is defined as $Z_{21}$, and the position of the tip of concave part 124*a* in the Z-axis direction is defined as $Z_{22}$. At this time, when feed unit 130 is at either position within the allowable range of movement, position $Z_{21}$ and position $Z_{12}$ establish a relationship in which $Z_{21}>Z_{12}$. In other words, according to this relationship, when the gap between the lower end of feed unit 130 and the top end of holding unit 120 is defined as d and the length of comb part 133*a* in the Z-axis direction is defined as L, length L is greater than the maximum value of gap d. When this relationship is established, regarding gaps generated at the positions where holding unit 120 faces feed unit 130, the maximum length continuing in the direction perpendicular to the Z-axis direction becomes shorter than in cases in which the relationship of the formula is not established, and parts forming a straight line become discontinuous rather than continuous. Intervals between adjacent comb parts (or concave parts) are determined preferably according to the dimensions of recording media M1.

In addition to wheels 117 described above, main body 110 also includes a component that connects with feed unit 130 when holding unit 120 is loaded. This connecting component is hereinafter referred to as the "connection part." The connection part is a part of main body 110 and is fixed to main body 110.

Figure 8A:
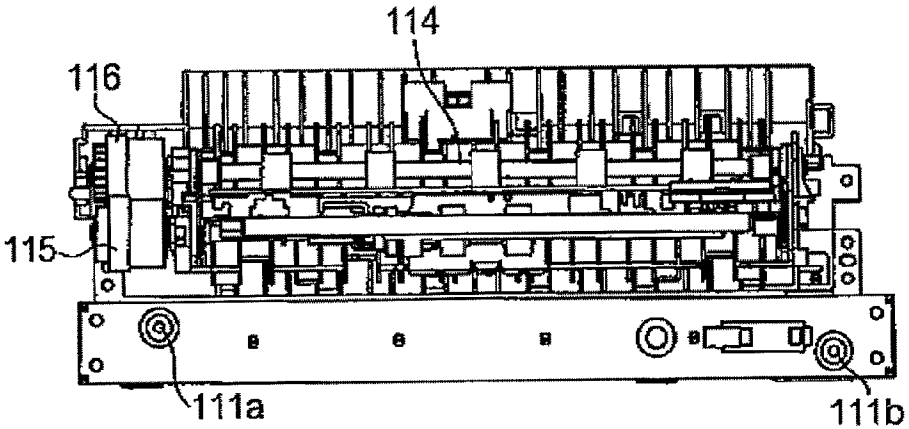
FIG. 8 shows a main body, particularly the connection part.
Figure 8B:
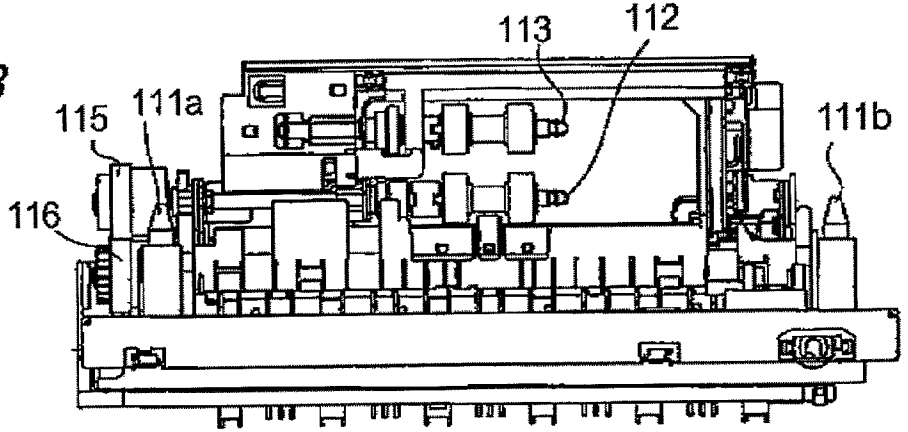
Figure 8C:
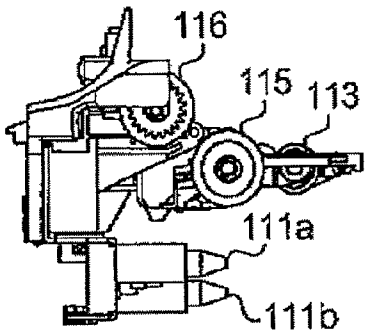

FIG. 8 shows main body 110, particularly the connection part. FIG. 8(*a*) shows the connection part from the loading direction, and FIG. 8(*b*) shows the connection part from below in the vertical direction relative to installation surface S1. Moreover, FIG. 8(*c*) shows the connection part from the direction perpendicular to the page in FIG. 1.

The connection part includes convex parts 111*a*, 111*b*, conveying members 112, 113, 114, and electromagnetic clutches 115, and 116. Each of convex parts 111*a*, and 111*b* is positioned so that when convex parts 111*a*, and 111*b* respectively connect to concave parts 131*a*, and 131*b* of feed unit 130, feed unit 130 is positioned at a predetermined position relative to the connection part (and main body 110 to which it is fixed). By working in concert, convex parts 111*a* and 111*b*, and concave parts 131*a* and 131*b* realize functions corresponding to a positioning mechanism according to an aspect of the present invention. Furthermore, in order to lengthen the interval therebetween, convex part 111*a* and convex part 111*b* are provided at both ends of the connection part.

Furthermore, the pair composed of convex part 111*a* and concave part 131*a* differs from the pair composed of convex part 111*b* and concave part 131*b* only in the position at which it is provided, and the specific configurations are the same. Therefore, in the following description, when there is no particular need for differentiation, convex parts 111*a* and 111*b* and concave parts 131*a* and 131*b* will be collectively referred to as "convex part 111" and "concave part 131," respectively.

Figure 9:
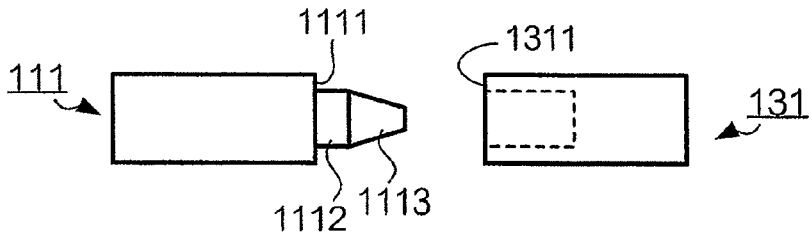
FIG. 9 shows a configuration of convex parts and concave parts.

FIG. 9 shows a configuration of convex part 111 and concave part 131. As shown in this figure, convex part 111 includes outer edge 1111, shank 1112, and tip part 1113. Moreover, concave part 131 includes outer edge 1311. Outer edge 1111 includes a surface corresponding to outer edge 1311 and restricts movement of concave part 131 in the loading direction. When concave part 131 moves up to a position where outer edge 1311 comes into contact with outer edge 1111, it does not move any further in the loading direction. Shank 1112 includes a cylindrical surface provided to fit with concave part 131 with no gaps, and restricts movement of concave part 131 in various directions perpendicular to the loading direction. Therefore, when convex part 111 is connected, movement of concave part 131 in directions other than the disengaging direction is restricted. Tip part 1113 includes a surface that guides positioning performed by convex part 111 and concave part 131. In other words, tip part 1113 is tilted to ensure that even when there is a difference in height between the position of convex part 111 and the position of concave part 131, these parts are mutually fitted and inserted. Furthermore, concave part 131 may have a configuration in which either of convex parts 131*a* or 131*b* is a so-called elongated hole and movement of convex part 111 is permitted.

Electromagnetic clutches 115 and 116 transmit a driving force provided by a motor (not shown) provided on main body 110 and, when necessary, cancels the transmission of this driving force. Electromagnetic clutches 115 and 116 (and the motor) are one example of a drive unit according to an aspect of the present invention.

Conveying member 112 is a roll-shaped member that receives the driving force transmitted by electromagnetic clutch 115 and rotates recording media M1 in the direction of discharge. Conveying member 112 faces conveying member 132 to form a nip region and pinches recording media M1 in this nip region and conveys the pinched recording media M1. Conveying member 112 is one example of a first conveying member according to an aspect of the present invention. Conveying member 113 is a roll-shaped member that is provided at a position above recording media M1 held in holding unit 120 and receives the driving force transmitted by electromagnetic clutch 115 to convey recording media M1. Conveying member 113 sends out the media on the uppermost surface of recording media M1 accumulated in holding unit 120 to the nip region described above. Conveying member 113 is one example of a third conveying member according to an aspect of the present invention. Conveying member 114 is a roll-shaped member that receives the driving force transmitted by electromagnetic clutch 116. Conveying member 114 conveys recording media M1 conveyed and sent out by conveying members 112 and 132 upward and supplies the media to image forming device 200.

Image forming device 200 includes holding unit 210 and image forming part 220. Holding unit 210 holds recording media M2 and supplies the media when necessary. Compared to holding unit 120, the receivable amount of recording media is lower in holding unit 210. Holding unit 210 may be configured so as to be attached and detached to and from image forming device 200, or, for example, a door may be provided on image forming device 200 and recording media may be supplied through this door. Image forming part 220 forms images on the supplied recording media M1 or M2. Image forming part 220 is one example of an image forming unit according to an aspect of the present invention. In the present exemplary embodiment, image forming part 220 is an electrophotographic image forming unit that forms images on recording media using toner. Furthermore, image forming part 220 may be either a unit that forms monochromatic images or a unit that forms polychromatic images.

Figure 10:
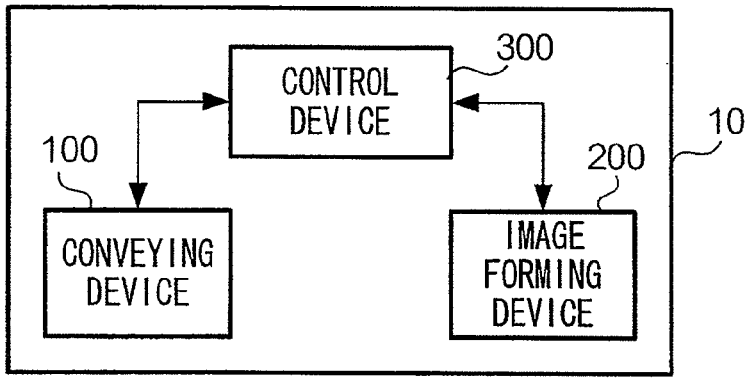
FIG. 10 is a block diagram showing the overall configuration of an image forming system.

FIG. 10 is a block diagram showing an overall configuration of image forming system 10. In addition to conveying device 100 and image forming device 200, image forming system 10 includes control device 300 that controls the actions of the entire system. Control device 300 may be provided inside conveying device 100 or image forming device 200, or it may be a separate device connected via a wire or wireless communication unit. Control device 300 is one example of a controller according to an aspect of the present invention.

Control device 300 includes a calculation unit, such as a CPU (Central Processing Unit) and a memory, and controls the actions of conveying device 100 and image forming device 200 by executing programs stored in advance. The types of control executed by control device 300 include control of image formation by image forming part 220 and control related to the conveyance of recording media. These types of control are implemented based on operations by a user. The types of control executed by control device 300 related to the conveyance of recording media include control of the timing of transmissions of driving force from electromagnetic clutches 115 and 116 as well as control of the amount of movement of lift 121. For example, control device 300 controls the driving of lift 121 according to the detection results of sensor 135. Specifically, when sensor 135 detects that lever 136 is at a predetermined position when control device 300 is causing lift 121 to ascend, control device 300 suspends the ascension of lift 121 and provides a supply of recording media M1.

The configuration of image forming system 10 of the present exemplary embodiment is as described above. Based on this configuration, image forming system 10 conveys recording media handled by holding unit 120 and forms images on the conveyed recording media using toner. The term "handle" as used here refers to separating a single sheet of recording media from a cluster of recording media. One of the characteristics of image forming system 10 of the present exemplary embodiment is that feed unit 130 engages in vertical motion so that the relative positional relationship between the connection part and feed unit 130 when holding unit 120 is loaded conforms to a predetermined relationship regardless of whether the weight of recording media M1 held in holding unit 120 is heavy or light. Furthermore, the range of vertical motion of feed unit 130 is determined by considering the tolerance of the components of each part.

FIG. 11 schematically shows the positional relationships of main body 110, holding unit 120, and feed unit 130 when holding unit 120 is loaded. This figure shows only the configurations necessary for describing the positional relationships, and other configurations have been omitted. Moreover, in the configurations shown in the figure, the dimensions have been emphasized. When feed unit 130 is loaded onto main body 110, as shown in FIG. 11A, it is located at a lower position relative to main body 110 compared to after it is loaded. In order to ensure that convex part 111 can be inserted into concave part 131 even when feed unit 130 is located at this preloading position, convex part 111 has a conical shape in which the diameter decreases toward the tip. In order words, this shape guides the positioning implemented by convex part 111 and concave part 131.

When feed unit 130 is moved further in the loading direction relative to the state shown in FIG. 11A, it moves upward along the shape of convex part 111 and, as shown in FIG. 11B, advances to a position at which concave part 131 hits against convex part 111. The state shown in FIG. 11B is a state in which feed unit 130 and the connection part have been properly positioned. At this position, feed unit 130 and the connection part cause the nip region where conveying member 132 faces conveying member 112 to generate an appropriate pressure (hereinafter referred to as "nip pressure") necessary for pinching recording media M1.

In holding unit 120, subduction, strain, and tilting are generated according to the weight of the held recording media M1 and the tolerance of the components of each part. Attaching parts 134*a*, 134*b*, 134*c*, and 134*d* of feed unit 130 function to balance out such instances of subduction and strain. As a result, when cases in which holding unit 120 is subdued (chain double-dashed line) and not subdued (solid line) are compared, although the relative position of feed unit 130 in relation to holding unit 120 is changed, the relative position in relation to the connection part is not changed. Consequently, the nip pressure generated at conveying member 132 and conveying member 112 is maintained without change in both cases.

2. Modified Examples

The exemplary embodiment described above is one example of the present invention. The present invention is not limited to the exemplary embodiment described above and may be implemented with the following modified examples.

Moreover, the present invention may also be implemented with an appropriate combination of the following modified examples.

2-1. Modified Example 1

Figure 12:
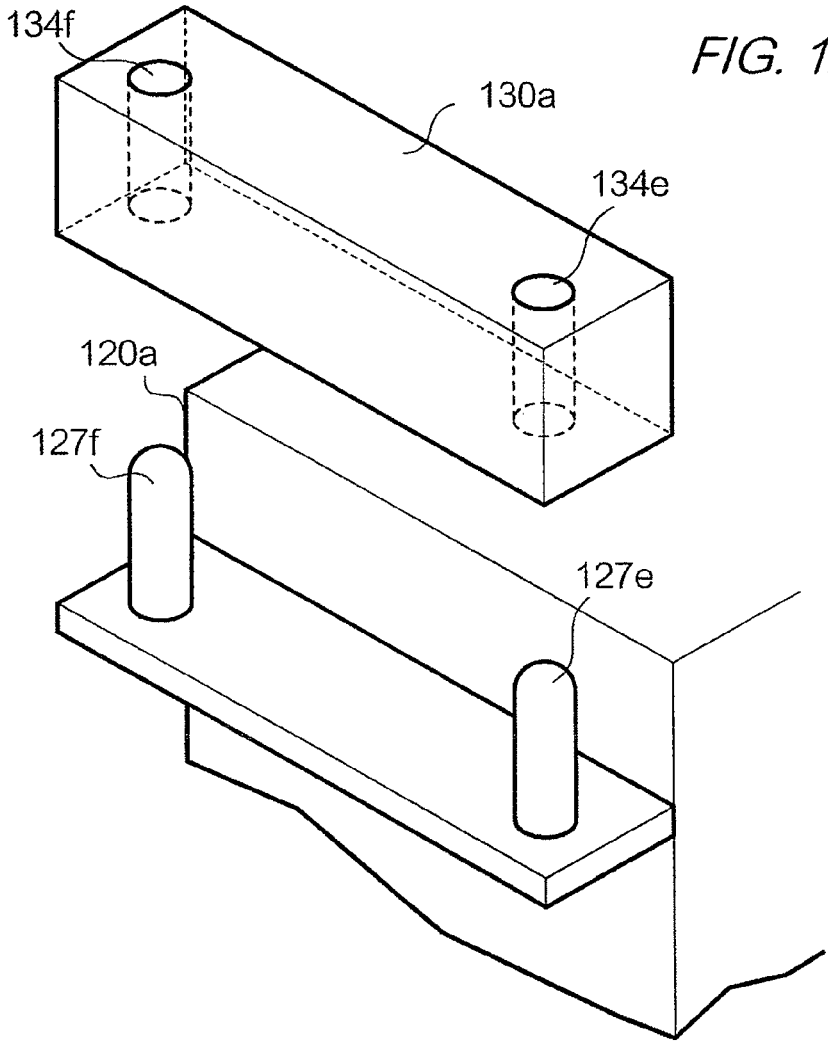
FIG. 12 schematically shows another example of an attaching part.

FIG. 12 schematically shows another example of an attaching part according to an aspect of the present invention. Feed unit 130*a* of the present example includes attaching parts 134*e* and 134*f* instead of attaching parts 134*a*, 134*b*, 134*c*, and 134*d* of the exemplary embodiment described above. Moreover, holding unit 120*a* of the present example includes pins 127*e* and 127*f* that are inserted into attaching parts 134*e* and 134*f*. Furthermore, with the exception of the configurations described here, holding unit 120*a* and feed unit 130*a* have the same configurations as holding unit 120 and feed unit 130 of the exemplary embodiment described above.

Pins 127*e* and 127*f* are fixed to holding unit 120*a* and are provided so that the axial direction is the vertical direction. Attaching parts 134*e* and 134*f* are perforations into which pins 127*e* and 127*f* are inserted allowing vertical motion of feed unit 130*a*. In the present example, feed unit 130*a* may engage in vertical motion within a predetermined range, or it may be configured separately from holding unit 120*a* with no restrictions on the range of vertical motion.

2-2. Modified Example 2

The convex and concave shapes formed in the gap between the holding unit and feed unit according to an aspect of the present invention, are not limited to those of the exemplary embodiment described above. For example, the number of comb parts and corresponding concave parts may be greater than or less than the number used in the exemplary embodiment described above. There are no specific limitations on the shape of the convex and concave shapes according to an aspect of the present invention as long as they have nonlinear components capable of preventing the entry of recording media.

Figure 13A:
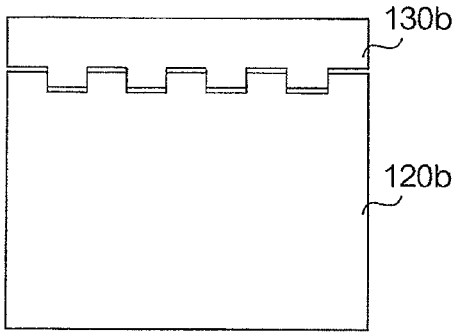
FIG. 13 shows another example of convex and concave shapes.
Figure 13B:
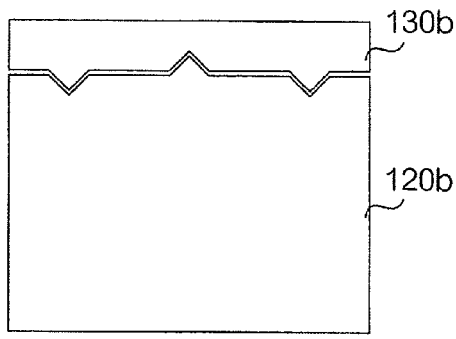

FIG. 13 shows another example of convex and concave shapes according to an aspect of the present invention. FIG. 13A shows an example in which rectangular convex and concave shapes are provided in the gap between holding unit 120*b* and feed unit 130*b*, and FIG. 13B shows an example in which angular convex and concave shapes are provided in the gap between holding unit 120*b* and feed unit 130*b*.

2-3. Modified Example 3

The positioning mechanism according to an aspect of the present invention may be realized with a configuration other than one involving pairs of convex parts and concave parts.

Figure 14:
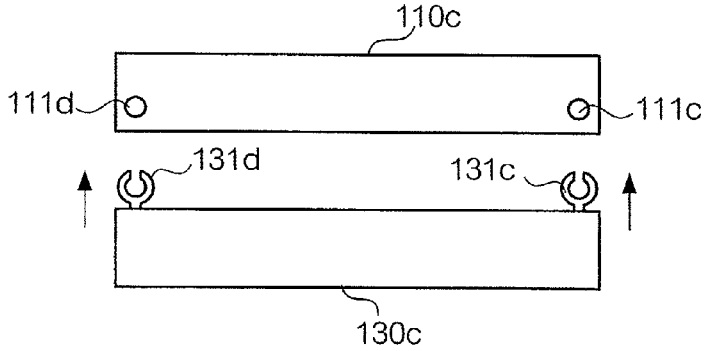
FIG. 14 shows another example of a positioning mechanism.

FIG. 14 shows another example of a positioning mechanism according to an aspect of the present invention as seen from above. In the present example, main body 110*c* includes pins 111*c* and 111*d* instead of convex parts 111*a* and 111*b* of main body 110 described above, and feed unit 130*c* includes latches 131*c* and 131*d* instead of concave parts 131*a* and 131*b* of feed unit 130 described above. Furthermore, with the exception of the configurations described here, main body 110*c* and feed unit 130*c* have the same configurations as main body 110 and feed unit 130 of the exemplary embodiment described above. Moreover, this configuration may be applied to the latches provided on the bottom surface of the holding unit.

Moreover, even when the positioning mechanism according to an aspect of the present invention is configured by pairs of convex parts and concave parts, the configuration is not limited to the example of the exemplary embodiment described above.

Figure 15:
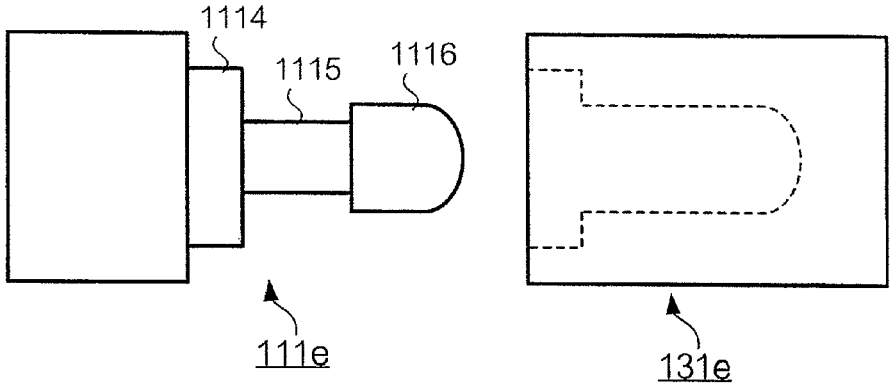
FIG. 15 is an example showing another example of pairs of convex parts and concave parts.

FIG. 15 shows another example of pairs of convex parts and concave parts. Here, convex part 111*e* includes large-diameter part 1114, small-diameter part 1115, and tip part 1116. Furthermore, large-diameter part 1114 and small-diameter part 1115 are each cylindrical, and tip part 1116 is circular with a rounded tip. Moreover, concave part 131*e* allows insertion of convex part 111*e*. Compared to cases in which small-diameter part 1115 has the same diameter as tip part 1116, convex part 111*e* is lighter in weight.

In the configuration of FIG. 15, convex part 111*e* is configured by providing small-diameter part 1115 between large-diameter part 1114 and tip part 1116, thus causing large-diameter part 1114 and tip part 1116 to come into contact with concave part 131*e* while small-diameter part 1115 does not come into contact with concave part 131*e*. In other words, in this case, large-diameter part 1114 and tip part 1116 act as contact surfaces for concave part 131*e*, while small-diameter part 1115 acts as a non-contact surface for concave part 131*e*. At this time, compared to cases in which the diameter of small-diameter part 1115 is equal to or greater than the diameter of tip part 1116, the area of convex part 111*e* that comes into contact with concave part 131*e* is smaller.

The positioning mechanism of the exemplary embodiment described above has a configuration in which convex parts 111*a* and 111*b* are provided on main body 110 while concave parts 131*a* and 131*b* are provided on feed unit 130. However, the positioning mechanism according to an aspect of the present invention may have a configuration in which the relationship of the concave parts and the convex parts is reversed to provide concave parts on the main body and convex parts on the feed unit, or it may have a configuration in which concave parts and convex parts are provided on both the main body and the feed unit.

Furthermore, when the positioning mechanism according to an aspect of the present invention is configured by pairs of convex parts and concave parts, the number of those pairs is not limited.

2-4. Modified Example 4

Regarding the first conveying member and the second conveying member according to an aspect of the present invention, it is sufficient if at least one is driven by the drive unit. Consequently, in the exemplary embodiment described above, conveying member 132 may be driven instead of conveying member 112. In this case, the drive unit is provided on the feed unit. Moreover, when the drive unit is provided on the feed unit, the third conveying member is provided on the feed unit and may be driven by the drive unit.

2-5. Modified Example 5

The image forming device according to an aspect of the present invention may be configured such that the above described conveying device 100 and image forming device 200 is a single unit. Moreover, the image forming device according to an aspect of the present invention may be one to which a positioning mechanism or the like is applied to holding unit 210 of image forming device 200. However, the positioning mechanism according to an aspect of the present invention is preferably applied to a holding unit capable of receiving a large amount of recording media rather than a holding unit capable of receiving a low amount of recording media.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A conveying device, comprising:

a main body including a first conveying member that conveys a single media;

a holding unit that holds a plurality of media accumulated in a vertical direction relative to an installation surface on which the conveying device is installed and is attached and detached to and from the main body through movement in a direction parallel to the installation surface;

a feed unit that feeds the single medium to the main body, and includes an attaching part and a second conveying member, the attaching part enabling the feed unit to attach to the holding unit, the second conveying member facing the first conveying member to pinch the media at a position facing the first conveying member so as to conveys the single media with the first conveying member;

a third conveying member that conveys a single medium, which is on the uppermost surface among the plurality of media held in the holding unit, to a position where the first conveying member and the second conveying member are opposed to each other, and is separated from the plurality of media; and a positioning mechanism that positions the main body and the feed unit so that the second conveying member is located at a predetermined position relative to the first conveying member when the holding unit is loaded on the main body, wherein the attaching part is configured to allow relative movement of the feed unit and the holding unit, the feed unit is positioned relative to the main body.

2. The conveying device according to claim 1, wherein the holding unit includes on the bottom surface a rail member that guides the movement of the holding unit.

3. The conveying device according to claim 1, wherein the holding unit includes mutually interlocking convex and concave shapes on both the top end of the lateral surface on the side of the holding unit sending out the media as well as the lower end of the feed unit that faces the top end.

4. The conveying device according to claim 1, wherein the positioning mechanism includes:

a plurality of convex parts that are provided at positions on the main body facing the feed unit and protrude toward the loaded holding unit; and a plurality of concave parts that are provided at positions on the feed unit facing the plurality of convex parts and into which any of the plurality of convex parts are inserted.

5. The conveying device according to claim 4, wherein the convex parts include a contact surface that contacts with the concave parts as well as a non-contact surface that does not contact with the concave parts when the concave parts are inserted.

6. The conveying device according to any claim 1, wherein the positioning mechanism includes:

a plurality of convex parts that are provided on the feed unit and protrude in the direction of movement when the holding unit is loaded; and a plurality of concave parts that are provided at positions on the holding unit facing the plurality of convex parts and into which any of the plurality of convex parts are inserted.

7. The conveying device according to claim 6, wherein the convex parts include a contact surface that contacts with the concave parts as well as a non-contact surface that does not contact with the concave parts when the concave parts are inserted.

8. The conveying device according to claim 1, wherein the main body or the feed unit includes the third conveying member, the feed unit includes a detection part that detects the position of the medium on the uppermost surface, and the conveying device further includes:

a transportation unit that moves the plurality of media held in the holding unit upward; and a controller that controls the movement of the plurality of media by the transportation unit according to the detected results of the detection part.

9. An image forming device, comprising:

the conveying device according to claim 1; and an image forming unit that forms images on the single medium conveyed by the conveying device.

10. The conveying device according to claim 1, wherein the attaching part is configured to allow relative movement between the feed unit and the holding unit in a direction perpendicular to the installation surface.

11. The conveying device according to claim 1, wherein the attaching part is configured to allow relative movement between the feed unit and the holding unit in a direction perpendicular to the installation surface when the holding unit is attached to the feed unit.

* * * * *